US005285194A

United States Patent [19]

Ferguson

[11] Patent Number: 5,285,194

[45] Date of Patent: Feb. 8, 1994

[54] ELECTRONIC ARTICLE SURVEILLANCE SYSTEM WITH TRANSITION ZONE TAG MONITORING

[75] Inventor: David B. Ferguson, Delray Beach, Fla.

[73] Assignee: Sensormatic Electronics Corporation, Deerfield Beach, Fla.

[21] Appl. No.: 976,547

[22] Filed: Nov. 16, 1992

[51] Int. Cl.[5] ..... G08B 13/18; G08B 13/24

[52] U.S. Cl. ..... 340/572; 340/551

[58] Field of Search ..... 340/572, 551

[56] References Cited

U.S. PATENT DOCUMENTS

| | | | |
|---|---|---|---|
| 4,063,229 | 12/1977 | Welsh et al. | 340/571 |
| 4,139,844 | 2/1979 | Reeder | 340/572 |
| 4,212,002 | 7/1980 | Williamson | 340/572 |
| 4,274,090 | 6/1981 | Cooper | 340/572 |
| 4,356,477 | 10/1982 | Vandebult | 340/572 |
| 4,510,489 | 4/1985 | Anderson et al. | 340/572 |
| 4,778,552 | 10/1988 | Benge et al. | 156/272.2 |
| 4,812,822 | 3/1989 | Feltz et al. | 340/572 |
| 4,859,991 | 8/1989 | Watkins et al. | 340/572 |

*Primary Examiner*—Glen R. Swann, III

*Attorney, Agent, or Firm*—Robin, Blecker, Daley & Driscoll

[57] ABSTRACT

An EAS system having a protection zone in which tags are to be detected and a transition zone outward of the protection zone beyond which tagged articles for sale and/or monitoring can be displayed. The EAS system includes a receiving and processing unit which processes received signals in accordance with first and second different criteria to develop a first signal which can, be used to indicate the presence of a tag in the protection zone and a second signal which can be used to indicate the presence of a tag in the transition zone. Visual indication of the tags in the transition zone is also selectively provided.

38 Claims, 4 Drawing Sheets

ELECTRONIC ARTICLE SURVEILLANCE SYSTEM WITH TRANSITION ZONE TAG MONITORING

BACKGROUND OF THE INVENTION

This invention relates to electronic article surveillance (EAS) systems and, in particular, to methods and apparatus for improving these systems.

In a typical EAS system, a protection zone is established through which articles must pass and which is under surveillance by the system. If an article having an EAS tag passes through the protection zone, the system detects the tag and, therefore, the article. The system then activates an alarm, thereby indicating the presence of a tagged article in the protection zone.

As can be appreciated, the reliability of an EAS system depends upon the system alarming only when tags within the protection zone cause the system to alarm. In order to promote reliability, most systems are configured so that a transition zone is provided between the protection zone and the other areas of the site or premises, i.e., the unprotected areas containing tagged articles for display and sale. The transition zone is devoid of such articles. Accordingly, the transition zone allows for a certain degree of expansion of the transmitted EAS signal beyond the protection zone, without the worry of false alarming the EAS system, i.e., alarming the system with tagged articles being displayed for sale.

While the use of a transition zone is beneficial for preventing false alarms, there is also a desire to minimize this zone so as not to waste valuable selling floor space. Realizing a transition zone of minimum extent concurrently with minimizing false alarming has not been easy to achieve.

One reason for this is that the transmitted signal is usually in the form of a transmitted field, i.e., a magnetic, electric or electromagnetic field or a combination thereof. Such, fields change in size and, therefore, may expand or contract with time.

These changes may occur due to environmental conditions such as temperature and power line levels. They may also occur due to field reflecting or absorbing objects (e.g., metal racks and doors as well as non-metal objects such as human beings) which interact with the transmitted field.

Another reason is that the distance of the tagged articles to the transition and protection zones may change. This occurs because the tagged articles may be moved by personnel not aware of these zones. However, moving the tagged articles for display into the transition zone can result in false alarms.

In present day EAS systems, the transition zone is usually determined on-site. Articles with tags are first brought into the protection zone until the EAS system alarms. The tagged articles are then moved slightly out of the zone, until the alarming stops. This establishes the desired transition zone.

Unfortunately, this procedure does not always account for the above-described expansion which might occur in the transmitted field. As a result, false alarms may likely result. These are usually corrected for by dispatching EAS personnel to the site. At the site, the transition zone is again reestablished by the EAS personnel by slightly moving the tagged articles further away from the protection zone until any false alarming stops. While this procedure offers a way of establishing and maintaining a transition zone, it is manpower intensive and, therefore, costly.

It is, therefore, an object of the present invention to provide an EAS system and method which do not suffer from the above disadvantages.

It is a further object of the present invention to provide an EAS system and method in which a transition zone can be established in a manner which preserves selling floor space as well as minimizes false alarms.

It is yet a further object of the present invention to provide an EAS system and method in which a transition zone can be easily and readily established and maintained.

SUMMARY OF THE INVENTION

In accordance with the principles of the present invention, the above and other objectives are realized in an EAS system which includes a receiving and processing means which is adapted to receive signals from the protection and transition zones and which processes these signals in accordance with first and second different criteria (i.e., criteria which differ in at least one respect). If this processing results in the first (or tag alarm) criteria being satisfied or met, a first signal is generated which can be used to indicate that a tag is present in the protection zone. If the processing results in the satisfaction of the second (or tags-too-close) criteria, which are made less stringent than the first criteria, a second signal is generated which can be used to indicate the presence of a tag in the transition zone. In this way, tag presence in the transition zone and, thus, too close to the protection zone, is made known without affecting detection of tag presence in the protection zone. Moreover, since tag presence in the transition zone is known, tags can be readily moved from the transition zone by untrained or non-EAS personnel.

In the embodiment of the invention to be disclosed hereinafter, the EAS system further includes an indicator for visually indicating that the second signal has been generated, i.e., that a tag is present in the transition zone. This indicator, however, is prevented from providing a visual indication, if the first signal, which indicates tag presence in the protection zone, has or is generated. Thus, a tag alarm condition is given priority over a tags-too-close condition. Moreover, in the disclosed embodiment, the EAS system is a microwave-type system which utilizes microwave tags and transmitted electromagnetic and electric fields.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1:
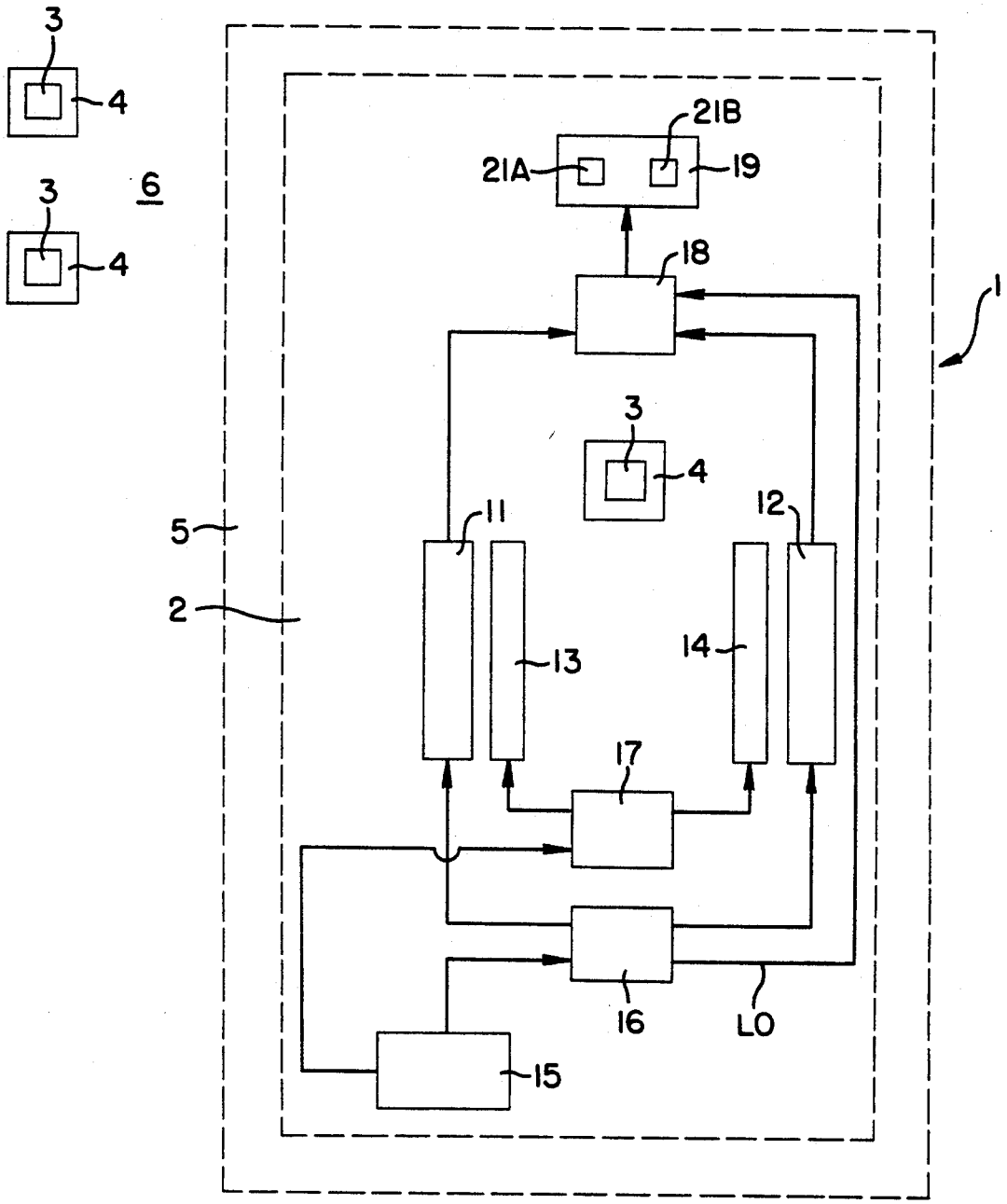
FIG. 1 is an EAS system in accordance with the principles of the present invention.

FIG. 1 shows an EAS system 1 in accordance with the principles of the present invention. The EAS system 1 is in the form of a RF microwave EAS system, although the principles of the present invention are applicable as well to other types of EAS systems, e.g., lower frequency RF systems and magnetic systems. RF microwave EAS systems are disclosed for example in U.S. Pat. Nos. 4,063,229 and 4,139,844. Lower frequency RF systems are described in U.S. Pat. Nos. 4,778,552 and 4,812,822 and magnetic systems in U.S. Pat. Nos. 4,859,991 and 4,510,489.

In FIG. 1, the EAS system is designed to establish a protection zone 2 in which microwave EAS tags 3 carried on articles 4 and passing through the zone will be detected and result in a system alarm. The system is also designed, in accord with the invention, to establish a transition zone 5 in which articles 4 carrying EAS tags 3 are not to be displayed and which separates the protection zone 2 from the remaining unprotected areas 6 of the premises or site. In the unprotected areas 6, articles 4 carrying EAS tags 3 are allowed to be displayed for purchasing.

As will be discussed in greater detail below, the design of the system 1 is such that undesired placement of the articles 4 and carried tags 3 in the transition zone 5 for display can be sensed and brought to the attention of the user of the system 1 without the system being in an alarm condition. This enables tagged articles 4 to be easily removed from the transition zone 5 by untrained personnel so that they are prevented from causing false alarms. False alarming in the system 1 is thus reduced, while the transition zone 5 can be minimized.

In FIG. 1, the system 1 comprises transmitter/-receiver antennas 11 and 12 which are adapted to transmit microwave RF signals or fields (e.g. in the 900 MHz frequency range) into the protection zone 2 at a specified level. The system 1 also includes antennas 13 and 14 which are adapted to transmit intermediate frequency electric fields (e.g., in the 100 kHz frequency range) into the zone 2.

A system controller 15 controls drive sources 16 and 17 for driving the antenna systems 11, 12 and 13, 14, respectively to generate the aforesaid signals. Typically, the drive source 17 may drive the antennas 13, 14 via a single frequency drive signal or via a frequency modulated (FM) drive signal. The drive source 16 can also drive the antennas 11, 12 with a single frequency or a FM signal.

The interaction of a microwave tag 3 with the fields from the antennas 11, 12 and 13, 14 results in the fields being mixed and reradiated. The reradiated fields have frequency content at the sum and difference frequencies of the mixed fields.

The transmitter/receiver antennas 11, 12 receive the reradiated microwave fields or signals from any tags in the zones 2 and 5 and couple the received signals to a system receiving and processing unit 18. This unit communicates with a display unit 19 having lamps 21 for indicating various conditions of the system. One of these lamps 21A is an alarm lamp which is controlled by the processing unit 18 to be lit when a tag 3 is detected in the zone 2. Another lamp 21B is an on/off lamp which is controlled by the processing unit 18 to be lit when the system 1 is on. The latter lamp also serves as a tags-too-close lamp and is further controlled by the processing unit 18 to blink (turn on and off) when a tag 3 is detected in the transition zone 5.

More particularly, in accord with the invention, the receiving and processing unit 18 is adapted to process received signals from the antennas 11, 12 in accordance with first and second different criteria. The first or tag alarm criteria, if satisfied, results in the processing unit generating a first signal which can be used to indicate a system alarm condition (i.e., to indicate presence of a tag 3 in the protection zone 2) by causing display unit 19 to light lamp 21A. The second or tags-too-close criteria, which is designed to be less stringent than the first criteria, if satisfied, results in the processing unit 18 generating a second signal which can be used to indicate a tags-too-close condition (i.e., to indicate presence of a tag 3, in the transition zone 5) by causing the display unit 19 to blink the lamp 21B.

The processing unit 18 is further adapted so that if both the first and second criteria are satisfied, i.e., the first and second signals are generated, only the first signal is permitted to affect the display unit 19. In this circumstance, the lamp 21A would be lit indicating a tag 3 in the protection zone 2. However, the lamp 21B would not be blinked, since the second signal would be prevented by the processing unit 18 from affecting the lamp unit 19. The processing unit 18 thus gives priority to an alarm condition when the alarm condition occurs concurrently with a tags-too-close condition.

Figure 2:
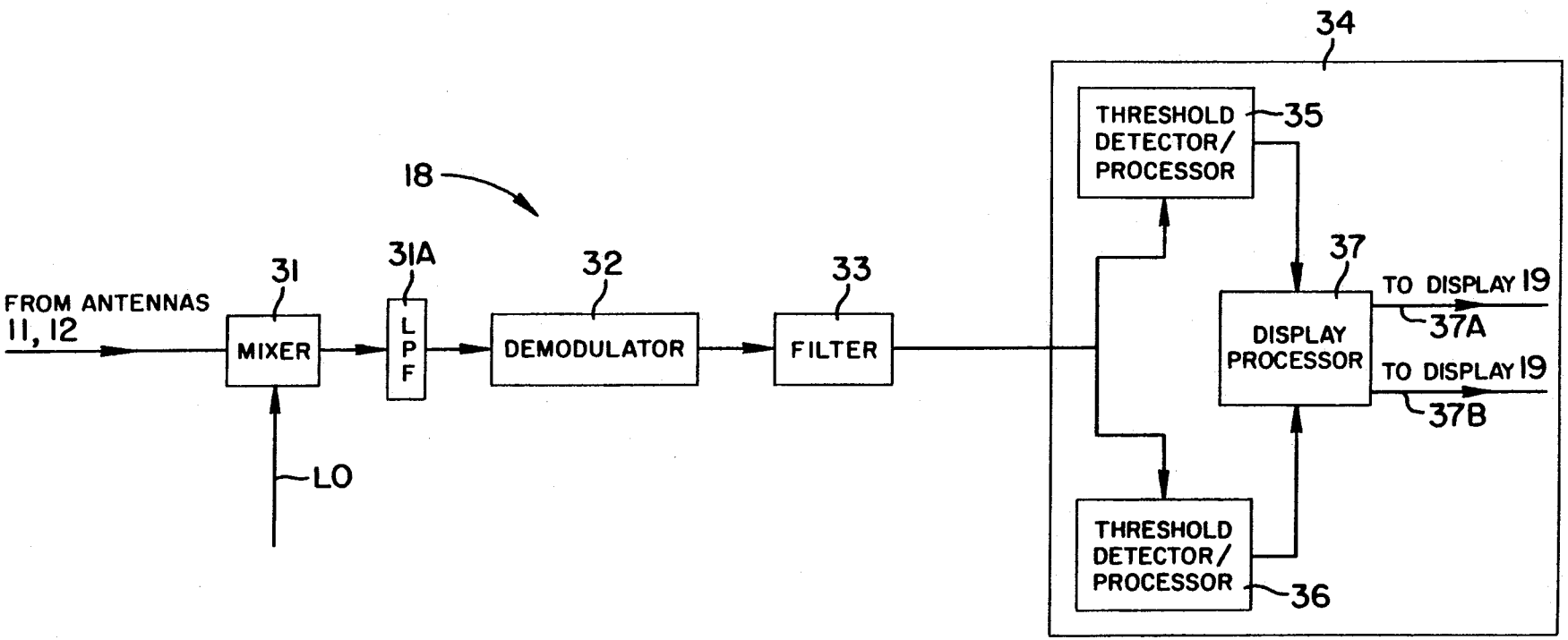
FIGS. 2–4 show different embodiments of the receiving and processing means of the system of FIG. 1.

FIG. 2 shows one form of the receiving and processing unit 18 in greater detail. As shown, the processing unit includes a mixer 31 which receives the RF microwave signal from the antennas 11, 12 and which also receives a local oscillator signal LO from the drive source 16. The mixer uses the latter signal to recover from the RF microwave signal the frequency content at the IF frequencies of the transmitted electric field. The mixer 31 is followed by a low pass filter 31A whose output is coupled to a demodulator 32. The demodulator 32 extracts from the low pass filter output the modulation frequency content (i.e., its content at the modulation frequency of the transmitted electric field) to develop a tag signal. The latter signal is filtered in a filter 33 and the filtered signal passed to a signal processing unit 34 which performs processing in accordance with the above-discussed first and second criteria.

To this end, the filtered tag signal is applied to separate first and second threshold detector/processors 35 and 36 included in the signal processing unit 34. The first threshold detector/processor 35 is adapted to process the filtered tag signal in accordance with the above-discussed first criteria and develops from its processed signal the first signal when the signal input to its threshold detector exceeds a first detection threshold level. The second threshold detector/processor 36 is adapted to process the filtered tag signal in accordance with the second criteria and develops from its processed signal the second signal when the signal input to its threshold detector exceeds a second detection threshold level which is lower than the first detection threshold level.

The first threshold detector/processor 35 thus generates the first signal in response to tag signals of higher level, as determined by its first detection threshold level, i.e., signals developed in the protection zone 2. The second threshold processor 36, in turn, generates the second signal in response to, tag signals of lower level as determined by its second threshold level, and, thus, signals developed outward of the protection zone, i.e., signals developed within the transition zone 5. By controlling the threshold detection levels of the first and second detector/processors, the extent of both zones can be controlled. In particular, the transition zone 5 can made larger or smaller as conditions dictate, thereby permitting a minimum zone to be realized for any given set of conditions.

The signals developed by the threshold detector/-processors 35 and 36 are coupled to a display processor 37. This processor selectively passes the signals to the display unit 19 on lines 37A and 37B for controlling the alarm condition lamp 21A and the tags-too-close condition lamp 21B, respectively. Specifically, the processor 37 passes the first signal to the alarm unit at all times that it is generated. The second signal, on the other hand, is passed to the unit at all times, except if an alarm condition is in effect, i.e., if the first signal has been or is passed to the alarm unit 19 to indicate an alarm condition which has not been cleared. The display processor 37 thus gives priority to the alarm condition and terminates or fails to initiate an indication of any tags-too-close condition at the display unit 19, until the alarm condition is cleared.

Each of the threshold detector/processors 35 and 36 can be adapted to operate by averaging their resultant processed signals over time and comparing the averaged value with its detection threshold. Averaging can be utilized because the tag signals will likely be relatively fixed in amplitude as compared to the environmental noise in the received signals. This enables the processors 35 and 36 to process received signals having a low signal-to-noise ratio, thus, improving the integrity of operation of the system 1.

Figure 3:
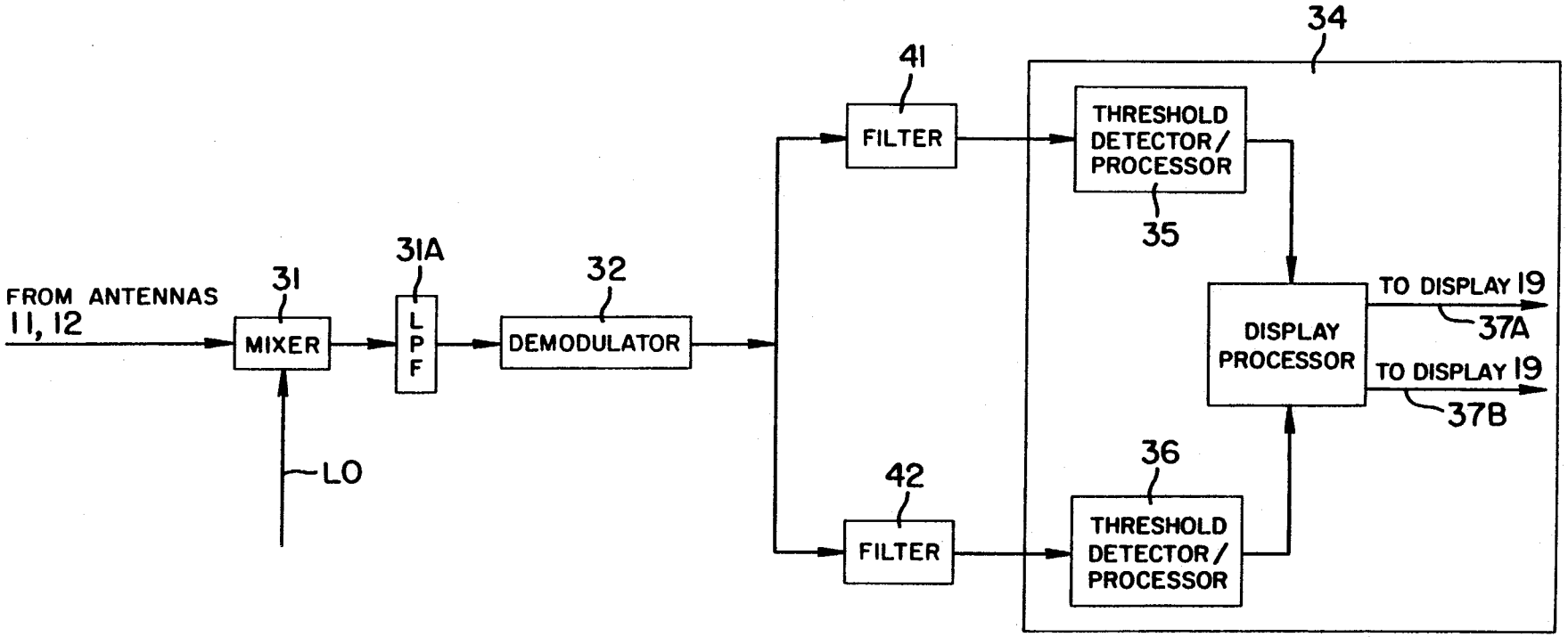
Figure 4:
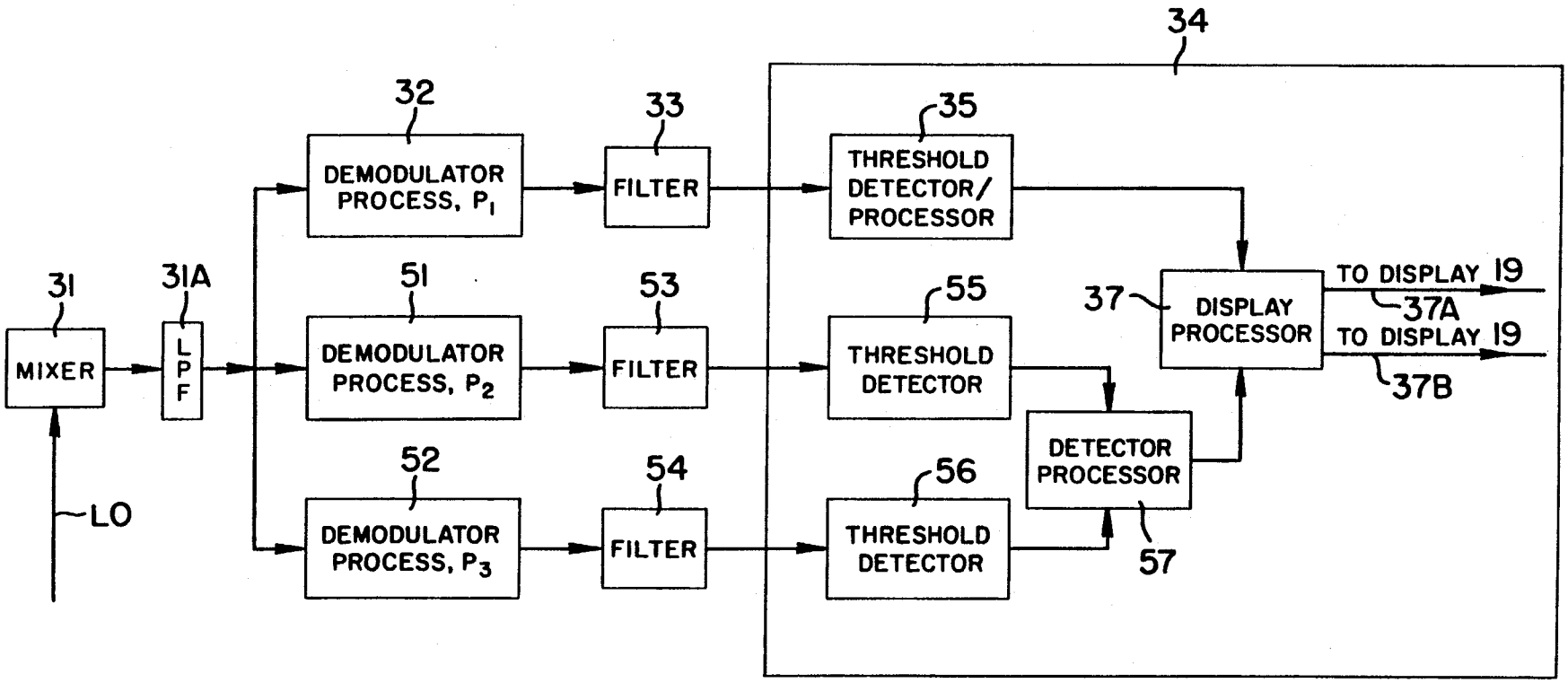

FIGS. 3 and 4 show modified embodiments of the receiving and processing means 18 of FIG. 2. In the FIG. 3 embodiment, separate filters 41 and 42 are employed for the tag signals used to determine the alarm and tags-too-close conditions, respectively, of the system 1. These filters result in separately filtered tag signals being applied to the processors 35 and 36. As a result, improved signal-to-noise ratios can be realized for the applied signals.

In the FIG. 4 embodiment, the FIG. 2 embodiment has been modified to employ different demodulators and demodulation processes for determining the alarm and tags-too-close conditions. Additionally, multiple channels are used for the tags-too-close determination.

As shown, the signal from the mixer 31 is passed through additional demodulators 51 and 52 which have demodulation processes $P_2$, $P_3$ which differ from the demodulation process $P_1$ of the demodulator 32. The outputs of the demodulators 51 and 52 are passed through separate filters 53 and 54 whose outputs, in turn, are fed to separate threshold detectors 55 and 56 having different threshold detection levels, both of which are lower than the threshold detection level of the processor 35. The outputs of the threshold detectors 55 and 56 are then passed to a detector processor 57 which forms the second signal depending upon the received outputs.

In a system representative of the present invention, a transition zone 5 of six inches was realized using a single FM demodulator for the demodulator 32 by making the detection threshold level of the detector 36 five dB less than that of the detection threshold level of the detector 35 based on the input signals to the receiving and processing unit 18. In the same system, by increasing the db difference in threshold levels to ten dB based on the inputs to the unit 18, a transition zone of one foot was achieved.

In another representative system, a single AM demodulator was used for the demodulator 32 and a dB difference in threshold levels of eleven dB based on the input signals to the unit 18 was used for the detectors 35 and 36. In this case, a transition zone 5 of three feet was obtained. Additionally, in a further representative system, the combination of an FM demodulator was used for the alarm condition determination and an AM demodulator for the tags-too-close determination. In this situation, an eleven dB difference in detection threshold level was again used and a transition zone of about three feet was obtained.

The variations in transition zone size in the above representative systems is due to the type of demodulation used. AM demodulation comprises a linear signal amplitude demodulation process. FM demodulation has a non-linear signal amplitude demodulation process due to the capture affect of the FM demodulator.

In the above representative system in which a five dB difference in detection levels was used, the signal-to-noise ratio for the detector 35 was 8 dB peak above peak noise floor. The signal-to-noise ratio for the detector 36 was 3 dB peak above the peak noise floor. By averaging the noise floors and signals, the signal-to-noise ratios for the detectors 35 and 36 can be raised to 14 dB and 9 dB, respectively.

As above-noted, while the present system has been illustrated in terms of a RF microwave EAS system, the principles of the invention are equally applicable to all other types of EAS systems, including lower frequency RF systems and magnetic systems. Also, while the system has been illustrated in terms of protecting articles which are being displayed for sale, the system is equally usable for monitoring articles to determine whether they are being removed from a location whether the articles are located in the location for sale or any other purpose. Finally, it should be noted that the parts of the system of the invention used for determining the tags-too-close condition can be incorporated into a separate detector unit instead of being incorporated into the receiving and processing unit of the EAS system.

In all cases it is understood that the above-described arrangements are merely illustrative of the many possible specific embodiments which represent applications of the present invention. Numerous and varied other arrangements, can be readily devised in accordance with the principles of the present invention without departing from the spirit and scope of the invention.

What is claimed is:

1. An EAS system for sensing the presence of EAS tags in a zone including a protection zone and a transition zone outward of said protection zone, said EAS system comprising:

means for transmitting a signal into said zone so as to reach at least said protection zone, means for receiving and processing signals received from said zone, said receiving and processing means processing said received signals in accordance with first and second different criteria, said first criteria, if satisfied, resulting in the generation of a first signal which can be used to indicate the presence of a tag in said protection zone, and said second criteria, if satisfied, resulting in the generation of a second signal which can be used to indicate the presence of a tag in said transition zone.

2. An EAS system in accordance with claim 1 wherein:

said second criteria is less stringent than said first criteria.

3. An EAS system in accordance with claim 1 further comprising:

means responsive to said receiving and processing means for providing a visual indication that said second signal has been generated.

4. An EAS system in accordance with claim 3 further comprising:

means responsive to said receiving and processing means for providing an indication that said first signal has been generated.

5. An EAS system in accordance with claim 4 wherein:

said receiving and processing means includes: an antenna means for receiving signals from said zone; and first and second channel processing means for processing the signals received by said antenna means in accordance with said first and second criteria.

6. An EAS system in accordance with claim 5 wherein:

said first and second channel processing means include first and second threshold detectors, respectively, said first and second threshold detectors having first and second threshold levels, respectively, for indicating detection of a signal, said second threshold level being lower than said first threshold level, and said second criteria including exceeding said second threshold level and said first criteria including exceeding said first threshold level.

7. An EAS system in accordance with claim 6 wherein:

said first and second threshold levels are signal amplitude threshold levels.

8. An EAS system in accordance with claim 6 wherein:

said first and second channel processing means have common demodulation means and common filter means preceding said first and second threshold detectors.

9. An EAS system in accordance with claim 6 wherein:

said first and second channel processing means have a common demodulation means and separate filter means preceding said first and second threshold detectors.

10. An EAS system in accordance with claim 6 wherein:

said first and second channel processing means have separate demodulation means and separate filter means preceding said first and second threshold detectors.

11. An EAS system in accordance with claim 3 wherein:

said means for providing a visual indication of said second signal is inhibited from providing said visual indication if said first signal is generated.

12. An EAS system in accordance with claim 11 wherein:

said means for providing a visual indication that said second signal has been generated includes a lamp.

13. An EAS system in accordance with claim 1 wherein said EAS tags are microwave tags and wherein:

said transmitting means includes: means for transmitting a microwave electromagnetic field into said zone.

14. An EAS system in accordance with claim 13 wherein said microwave tags include means for mixing signals received by said microwave tags and wherein:

said transmitting means includes: means for transmitting an electric field into said zone.

15. An EAS system in accordance with claim 13 further comprising:

said EAS tags.

16. An EAS system in accordance with claim 1 wherein said EAS tags are radio frequency tags and wherein:

said transmitting means includes: means for transmitting an electromagnetic field into said zone.

17. An EAS system in accordance with claim 16 further comprising:

said EAS tags.

18. An EAS system in accordance with claim 1 wherein said EAS tags are magnetic tags and wherein:

said transmitting means includes means for transmitting a magnetic field into said zone.

19. An EAS system in accordance with claim 18 further comprising:

said EAS tags.

20. A method for sensing the presence of EAS tags in a zone including a protection zone and a transition zone outward of said protection zone, said method comprising:

transmitting a signal into said zone so as to reach at least said protection zone, receiving and processing signals received from said zone, said receiving and processing including processing said received signals in accordance with first and second different criteria, said first criteria, if satisfied, resulting in the generation of a first signal which can be used to indicate the presence of a tag in said protection zone, and said second criteria, if satisfied, resulting in the generation of a second signal which can be used to indicate the presence of a tag in said transition zone.

21. A method in accordance with claim 20 wherein:

said second criteria is less stringent than said first criteria.

22. A method in accordance with claim 21 further comprising:

providing a visual indication that said second signal has been generated.

23. A method in accordance with claim 22 further comprising:

providing an indication that said first signal has been generated.

24. A method in accordance with claim 23 wherein:

said receiving and processing includes: receiving with an antenna means signals from said zone; and processing in first and second channels the signals received by said antenna means in accordance with said first and second criteria.

25. A method in accordance with claim 24 wherein:

said processing in said first channel includes determining whether a signal exceeds a first threshold level and said processing in said second channel includes determining whether a signal exceeds a second threshold level, said second threshold level being lower than said first threshold level;

and said second criteria including exceeding said second threshold level and said first criteria including exceeding said first threshold level.

26. A method in accordance with claim 25 wherein:

said first and second threshold levels are signal amplitude threshold levels.

27. A method in accordance with claim 25 wherein:

said processing in said first and second channels includes demodulating and filtering a common signal before said threshold determinations are made.

28. A method in accordance with claim 25 wherein:

said processing in said first and second channels includes demodulating a common signal and filtering separate signals before said threshold determinations are made.

29. A method in accordance with claim 25 wherein:

said processing in said first and second channels includes demodulating and filtering separate signals before said threshold determinations are made.

30. A method in accordance with claim 22 further comprising:

inhibiting said providing of said visual indication of said second signal if said first signal has been or is generated.

31. A method in accordance with claim 30 wherein:

said providing of said visual indication that said second signal has been generated is provided by a lamp.

32. A method in accordance with claim 20 wherein said EAS tags are microwave tags and wherein:

transmitting includes: transmitting a microwave electromagnetic field into said zone.

33. A method in accordance with claim 32 wherein said microwave tags mix signals received by said microwave tags and wherein:

said transmitting includes: transmitting an electric field into said zone.

34. A method in accordance with claim 20 wherein said EAS tags are radio frequency tags and wherein:

said transmitting includes: transmitting an electromagnetic field into said zone.

35. A method in accordance with claim 20 wherein said EAS tags are magnetic tags and wherein:

said transmitting includes: transmitting a magnetic field into said zone.

36. A detector for use with an EAS system, said EAS system sensing the presence of EAS tags in a zone including a protection zone and a transition zone outward of said protection zone and comprising: means for transmitting a signal into said zone so as to reach at least said protection zone; and means for receiving and processing signals received from said zone, said receiving and processing means processing said received signals in accordance with a first criteria, said first criteria, if satisfied, resulting in the generation of a first signal which can be used to indicate the presence of a tag in said protection zone; and said detector comprising;

first means responsive to said signals received by said receiving and processing means of said EAS system;

and processing means responsive to said first means for processing said received signals in accordance with a second criteria different from said first criteria, said second criteria, if satisfied, resulting in the generation of a second signal which can be used to indicate the presence of a tag in said transition zone.

37. A detector in accordance with claim 36 wherein:

said second criteria is less stringent than said first criteria.

38. A detector in accordance with claim 36 further comprising:

means responsive to said processing means for providing a visual indication that said second signal has been generated.

* * * * *